US011176893B2

(12) United States Patent
Zeng

(10) Patent No.: US 11,176,893 B2
(45) Date of Patent: Nov. 16, 2021

(54) DEMUX DISPLAY PANEL AND OLED DISPLAY

(71) Applicant: Wuhan China Star Optoelectronics Semiconductor Display Technology Co., Ltd., Wuhan (CN)

(72) Inventor: Mian Zeng, Wuhan (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 237 days.

(21) Appl. No.: 16/319,340

(22) PCT Filed: Aug. 1, 2018

(86) PCT No.: PCT/CN2018/097842

§ 371 (c)(1),
(2) Date: Jan. 20, 2019

(87) PCT Pub. No.: WO2019/214090

PCT Pub. Date: Nov. 14, 2019

(65) Prior Publication Data

US 2020/0126489 A1 Apr. 23, 2020

(30) Foreign Application Priority Data

May 10, 2018 (CN) ..... 201810440975.4

(51) Int. Cl.

| | |
|---|---|
| ***G09G 3/3291*** | (2016.01) |
| ***G09G 3/3258*** | (2016.01) |
| ***G09G 3/3266*** | (2016.01) |
| ***G09G 3/3225*** | (2016.01) |

(52) U.S. Cl.

CPC ..... *G09G 3/3291* (2013.01); *G09G 3/3258* (2013.01); *G09G 3/3266* (2013.01); *G09G 2310/0297* (2013.01)

(58) Field of Classification Search

CPC ..... G09G 3/3685; G09G 3/3688; G09G 2310/0297; G09G 2300/0804

See application file for complete search history.

(56) References Cited

U.S. PATENT DOCUMENTS

| | | | | |
|---|---|---|---|---|
| 7,505,017 | B1 * | 3/2009 | Yeo | G09G 3/3688 345/87 |
| 2006/0071884 | A1 * | 4/2006 | Kim | G09G 3/3233 345/76 |
| 2006/0151745 | A1 * | 7/2006 | Kim | G09G 3/325 252/301.16 |

(Continued)

FOREIGN PATENT DOCUMENTS

| | | |
|---|---|---|
| CN | 1710636 | 12/2005 |
| CN | 102646389 | 8/2012 |

(Continued)

*Primary Examiner* — Sepehr Azari

(57) ABSTRACT

A demultiplexer (DEMUX) display panel comprising an array substrate, a plurality of DEMUX switches, and a second control signal generating circuit which is connected to a second control signal input terminal and is configured to generate a second control signal. The second control signal is sent to the DEMUX switch before scanning each row of the sub-pixels to make the DEMUX switch transmit a reset signal to the corresponding first data lines through both of the data signal output terminals.

12 Claims, 4 Drawing Sheets

(56) References Cited

U.S. PATENT DOCUMENTS

| | | | | |
|---|---|---|---|---|
| 2007/0242016 | A1* | 10/2007 | Choi | G09G 3/3233 345/92 |
| 2011/0025678 | A1* | 2/2011 | Chung | G09G 3/3233 345/213 |
| 2011/0115761 | A1 | 5/2011 | Takei et al. | |
| 2012/0019499 | A1 | 1/2012 | Hwang et al. | |
| 2013/0215092 | A1 | 8/2013 | Wu et al. | |
| 2018/0047353 | A1* | 2/2018 | Lin | G09G 3/36 |
| 2018/0197465 | A1 | 7/2018 | Roh | |
| 2018/0197466 | A1 | 7/2018 | Roh | |
| 2018/0211597 | A1* | 7/2018 | Yl | G09G 3/3291 |
| 2018/0240400 | A1 | 8/2018 | Zhou et al. | |
| 2019/0311662 | A1* | 10/2019 | Kim | G09G 3/2003 |
| 2020/0035151 | A1* | 1/2020 | Feng | G09G 3/3233 |

FOREIGN PATENT DOCUMENTS

| | | |
|---|---|---|
| CN | 104112423 | 10/2014 |
| CN | 104616619 | 5/2015 |
| CN | 106847181 | 6/2017 |
| CN | 107680537 | 2/2018 |

* cited by examiner

DEMUX DISPLAY PANEL AND OLED DISPLAY

RELATED APPLICATIONS

This application is a National Phase of PCT Patent Application No. PCT/CN2018/097842 having International filing date of Aug. 1, 2018, which claims the benefit of priority of Chinese Patent Application No. 201810440975.4 filed on May 10, 2018. The contents of the above applications are all incorporated by reference as if fully set forth herein in their entirety.

FIELD AND BACKGROUND OF THE INVENTION

The present disclosure relates to liquid crystal displays (LCDs), and in particular to a demultiplexer (DEMUX) LCD panel and an organic light-emitting diode (OLED) display.

OLEDs have broad gamut, high contrast, low power consumption and flexibility, thus OLEDs have high competitiveness in display area. Active-matrix organic light-emitting diodes (AMOLEDs) are a target field in developing flexible displays. A driving circuit of AMOLED is 2T1C structure which includes a switch thin film transistor, a driving thin film transistor, and a storage capacitor.

However, in present OLED display panels, current DEMUX circuits and time sequences have disadvantages, such as data signals cannot be written as usually and will result in display error.

Therefore, the disadvantages exist in present technologies require urgent improvements.

SUMMARY OF THE INVENTION

The objection of the present disclosure is proving a DENUS display panel and an OLED display to improve the display error.

A demultiplexer (DEMUX) display panel, comprising:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data line connects between the at least two data signal output terminals and at least two of the sub-pixels;

a first control signal generating circuit connected to the at least two first control signal input terminals, and configured to generate a first control signal, wherein the first control signal is sent to one of the corresponding first control signal input terminals to make the DEMUX switch transmit a data signal to the corresponding sub-pixels through a corresponding data signal output terminal;

a second control signal generating circuit connected to the second control signal input terminal, and configured to generate a second control signal, wherein the second control signal is sent to the DEMUX switch before scanning the sub-pixels to make the DEMUX switch transmit a reset signal to the corresponding first data line through both of the data signal output terminals;

wherein the DEMUX switch comprises at least two first transistors and at least two second transistors;

wherein an input terminal of the first transistor connects to the corresponding second data line, an output terminal of the first transistor connects to one of the corresponding data line and the corresponding sub-pixels, a gate of the first transistor connects to the first control signal generating circuit;

wherein the input terminals of both of the first transistor connect to input terminals of one of the second transistors, the output terminals of both of the first transistor connects to output terminals of the corresponding second transistors, gates of the at least two second transistors connect to each other to receive the second control signal;

each of the DEMUX switches comprises two data signal output terminals connected to two different colored sub-pixels.

In the DEMUX display panel of the present disclosure, the first transistor and the second transistor are N-type field-effect transistors.

In the DEMUX display panel of the present disclosure, the two different colored sub-pixels are a red sub-pixel and a green sub-pixel, or the two different colored sub-pixels are a blue sub-pixel and a green sub-pixel.

In the DEMUX display panel of the present disclosure, the data signal output terminals of the DEMUX switches transmit low potential voltages as the reset signals to the corresponding second data lines before scan lines receive scan signals.

In the DEMUX display panel of the present disclosure, each of the DEMUX switches comprises four data signal output terminals connected to a red sub-pixel, a blue sub-pixel and two green sub-pixels.

In the DEMUX display panel of the present disclosure, each of the DEMUX switches comprises three data signal output terminals connected to a red sub-pixel, a blue sub-pixel and a green sub-pixel.

In the DEMUX display panel of the present disclosure, each of the sub-pixels comprises a first thin film transistor, a second thin film transistor, a third thin film transistor, a fourth thin film transistor, a fifth thin film transistor, a sixth thin film transistor, a seventh thin film transistor, an organic light-emitting diode, and a storage capacitor;

wherein an input terminal of the fourth thin film transistor and an input terminal of the seventh thin film transistor receive a Vi voltage, an output terminal of the fourth thin film transistor connects to a first terminal of the storage capacitor, a gate of the first thin film transistor and an input terminal of the third thin film transistor, a gate of the fourth thin film transistor and a gate of the seventh thin film transistor connect to an (n−1)th scan line, the output terminal of the fourth thin film transistor and an output terminal of the seventh thin film transistor connect to the organic light-emitting diode and an output terminal of the sixth thin film transistor, a second terminal of the storage capacitor connects to an input terminal of the fifth thin film transistor and receives a VDD voltage, an output terminal of the fifth thin film transistor and an output terminal of the second thin film transistor connect to an input terminal of the first thin film transistor, in output terminal of the first thin film transistor connects to an output terminal of the third thin film transistor and an input terminal of the sixth thin film transistor, a gate of the fifth thin film transistor connects to a gate of the sixth thin film transistor, a gate terminal of the second thin film transistor connects to a gate of the third thin film transistor and the (n)th scan line, an input terminal of the second thin film transistor connects to one of the corresponding first data lines.

A demultiplexer (DEMUX) display panel, comprising:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data line connects between the at least two data signal output terminals and at least two of the sub-pixels;

a first control signal generating circuit connected to the at least two first control signal input terminals, and con figured to generate a first control signal, wherein the first control signal is sent to one of the corresponding first control signal input terminals to make the DEMUX switch transmit a data signal to the corresponding sub-pixels through a corresponding data signal output terminal;

a second control signal generating circuit connected to the second control signal input terminal, and con figured to generate a second control signal, wherein the second control signal is sent to the DEMUX switch before scanning the sub-pixels to make the DEMUX switch transmit a reset signal to the corresponding first data lines through both of the data signal output terminal.

In the DEMUX display panel of the present disclosure, the DEMUX switch comprises at least two first transistors and at least two second transistors; wherein an input terminal of the first transistor connects to the corresponding second data line, an output terminal of the first transistor connects to one of the corresponding data line and the corresponding sub-pixels, a gate of the first transistor connects to the first control signal generating circuit;

wherein the input terminals of both of the first transistor connect to input terminals of the second transistors, the output terminals of both of the first transistor connect to output terminals of the corresponding second transistors, gates of the at least two second transistors connect to each other to receive the second control signal.

In the DEMUX display panel of the present disclosure, the first transistors and the second transistors are N-type field-effect transistors.

In the DEMUX display panel of the present disclosure, each of the DEMUC switches comprises two data signal output terminals connected to two different colored sub-pixels.

In the DEMUX display panel of the present disclosure, the two different colored sub-pixels are a red sub-pixel and a green sub-pixel, or the two different colored sub-pixels are a blue sub-pixel and a green sub-pixel.

In the DEMUX display panel of the present disclosure, the data signal output terminals of the DEMUX switches transmit low potential voltages as the reset signals to the corresponding second data lines before scan lines receive scan signals.

In the DEMUX display panel of the present disclosure, each of the DEMUX switches comprises four data signal output terminals connected to a red sub-pixel, a blue sub-pixel and two green sub-pixels.

In the DEMUX display panel of the present disclosure, each of the DEMUX switches comprises three data signal output terminals connected to a red sub-pixel, a blue sub-pixel and a green sub-pixel.

In the DEMUX display panel of the present disclosure, each of the sub-pixels comprises a first thin film transistor, a second thin film transistor, a third thin film transistor, a fourth thin film transistor, a fifth thin film transistor, a sixth thin film transistor, a seventh thin film transistor, an organic light-emitting diode, and a storage capacitor; wherein an input terminal of the fourth thin film transistor and an input terminal of the seventh thin film transistor receive a Vi voltage, an output terminal of the fourth thin film transistor connects to a first terminal of the storage capacitor, a gate of the first thin film transistor and an input terminal of the third thin film transistor, a gate of the fourth thin film transistor and a gate of the seventh thin film transistor connect to an (n−1)th scan line, the output terminal of the fourth thin film transistor and an output terminal of the seventh thin film transistor connect to the organic light-emitting diode and an output terminal of the sixth thin film transistor, a second terminal of the storage capacitor connects to an input terminal of the fifth thin film transistor and receives a VDD voltage, an output terminal of the fifth thin film transistor and an output terminal of the second thin film transistor connect to an input terminal of the first thin film transistor, in output terminal of the first thin film transistor connects to an output terminal of the third thin film transistor and an input terminal of the sixth thin film transistor, a gate of the fifth thin film transistor connects to a gate of the sixth thin film transistor, a gate of the second thin film transistor connects to a gate of the third thin film transistor and the (n)th scan line, an input terminal of the second thin film transistor connects to one of the first data lines.

A organic light-emitting diode (OLED) display comprising a demultiplexer (DEMUX) display panel, the DEMUX display panel comprises:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data line connects between the at least two data signal output terminals and at least two of the sub-pixels;

a first control signal generating circuit connected to the at least two first control signal input terminals, and con figured to generate a first control signal, wherein the first control signal is sent to one of the corresponding first control signal input terminals to make the DEMUX switch transmit a data signal to the corresponding sub-pixels through a corresponding data signal output terminal;

a second control signal generating circuit connected to the second control signal input terminal, and con figured to generate a second control signal, wherein the second control signal is sent to the DEMUX switch before scanning the sub-pixels to make the DEMUX switch transmit a reset signal to the corresponding first data lines through both of the data signal output terminal.

In the DEMUX display panel of the present disclosure, the DEMUX switch comprises at least two first transistors and at least two second transistors;

wherein an input terminal of the first transistor connects to the corresponding second data line, an output terminal of the first transistor connects to one of the corresponding data line and the corresponding sub-pixels, a gate of the first transistor connects to the first control signal generating circuit;

wherein the input terminals of both of the first transistor connect to input terminals of one of the second transistors, the output terminals of both of the first transistor connect to output terminals of the corresponding second transistors, gates of the at least two second transistors connect to each other to receive the second control signal.

In the DEMUX display panel of the present disclosure, the first transistors and the second transistors are N-type field-effect transistor.

In the DEMUX display panel of the present disclosure, each of the DEMUX switches comprises two data signal output terminals connected to two different colored sub-pixels.

The present disclosure utilizing the second control signal generating circuit, which is connected to the second control signal input terminal, to generate and transmit the second control signal to the DEMUX switch before starting scanning each rows of the sub-pixels, so that the DEMUX switch sent the reset signals to the corresponding first data lines in the purpose of resetting the corresponding first data lines. Thus, the error happening during writing the data signals into the first data lines that resulted from the higher voltage potential of the (n−1)th first data line in comparison with the voltage potential of the nth first data line. As the result, the problems of displaying errors are solved.

To clarify the technology method of the embodiments of the present disclosure, the following context will introduce the drawings representing the embodiments of the present disclosure. Obviously, the described drawings are only a part but not all of the drawings for exemplifying the present invention instead of limiting the present invention. For a skilled person in the art, other drawings may be obtained by referencing the drawings of the present disclosure without creative efforts.

DESCRIPTION OF SPECIFIC EMBODIMENTS OF THE INVENTION

Figure 1:
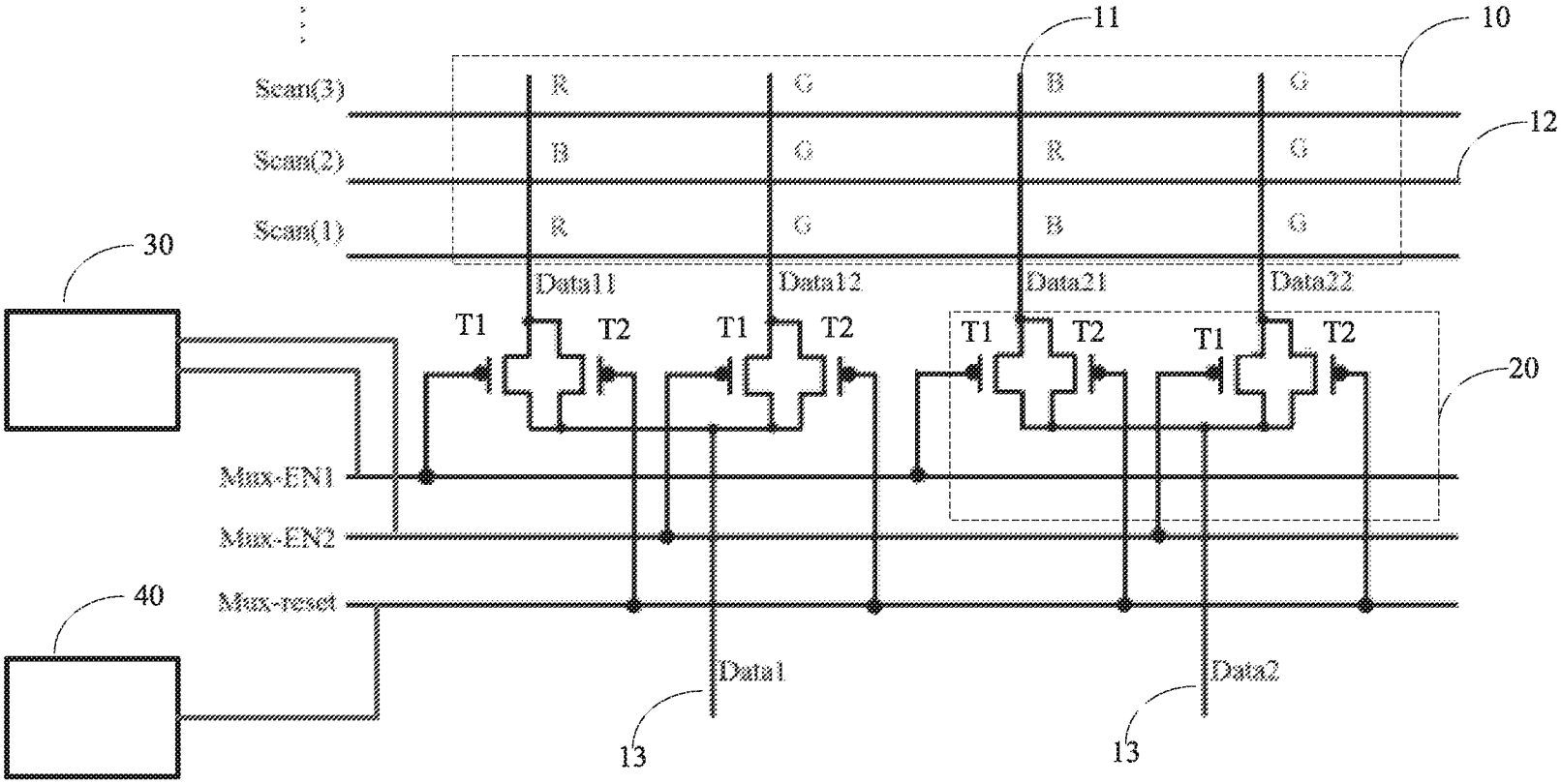
FIG. 1 illustrates a structure of a first embodiment of a DEMUX display panel of the present disclosure.

To further illustrate the technical methods adopted by the present invention and the effects thereof, the following describes the preferable embodiments of the present invention and the accompanying drawings in detail. In the drawings, units having the same or similar structures are numbered the same or similar. The described embodiments accompanying with drawings are examples rather than limitations for explaining the present.

The illustrations of the following embodiments take the attached drawings as reference to indicate the applicable specific examples of the present disclosure. The mentioned directional terms, such as central, vertical, horizontal, length, width, upper, lower, front, back, left, right, inner, perpendicular, plane, top, bottom, outer, clockwise, anti-clockwise, etc., are only directions by referring to the accompanying drawings, and thus the used directional terms are used to describe and understand the present invention, but the present invention is not limited thereto. In addition, the terms "first" or "second" are only descriptive, not for indicating the relevant importance or the numbers of technical features. Therefore, the features containing "first" and "second" could be indicative inclusion of one or more such features. In the description of present disclosure, "plurality" means two or more, unless there are additional instructions.

In the specification of present disclosure, the terms install, connect, link should be explain as broad as possible unless there are specific rules or limitations. For example, connection can be fixed connection, removable connection or integral connection; link can be electrical coupling or communication; connection can be direct connection, indirect connection via a media, and connection between two inner components or mutual affection between two components. For a skilled person in the art, the above-mentioned term can be understood according to the practical conditions in the present disclosure.

In the present disclosure, unless there are specific rules or limitations, the description "the first feature is above or under the second feature" includes situations that the first feature directly contact the second feature or the first feature indirectly contact the second feature via a media. In addition, the description "the first feature is above the second feature" includes situations that the first feature is right above the second feature, the first feature in the incline top of the second feature, or the vertical height of the first feature is higher than the vertical height of the second feature. The description "the first feature is under the second feature" includes situations that the first feature is right below the second feature, the first feature in the oblique bellow of the second feature, or the vertical height of the first feature is lower than the vertical height of the second feature.

The present disclosure provides various embodiments and examples for implementing different structures of the present disclosure. To simplify the specification of the present disclosure, the following context just illustrates some parts and arrangements of specification embodiments. Obviously, the described embodiments are only a part but not all of the embodiments for exemplifying the present invention instead of limiting the present invention. In addition, repeated reference numbers or letters in different embodiments are in the purpose of simplifying and clarifying, there repeated reference number or letters do not provide the suggestion of the relationship between embodiments and arrangements. All other embodiments obtained by persons of ordinary skill in the art based on the embodiments of the present invention without creative efforts shall fall within the protection scope of the present invention.

Please refer to FIG. 1. FIG. 1 illustrates an embodiment of demultiplexer (DEMUX) display panel. The DEMUX display panel includes an array substrate 10, a DEMUX switch 20, a first control signal generating circuit 30, and a second control signal generating circuit 40.

The array substrate 10 includes a plurality of first data lines 11 intersecting a plurality of scan lines 12. Pixel areas are defined by of a plurality of first data lines 11 intersecting a plurality scan lines 12. Each of the pixel areas includes sub-pixels, such as red sub-pixels, blue sub-pixels, and green sub-pixels.

Each of the DEMUX switches 20 includes at least one data signal input terminal, at least two data signal output terminals, at least two first control signal input terminal and a second control signal input terminal. The data single input terminal couples to a corresponding second data line 13 to receive a data signal. Each of the at least two data signal output terminals couples to at least two sub-pixels via first data lines 11.

The first control signal generating circuit 30 is configured to generate first control signals, and is connected to the at least two first control signal input terminal. The first control signal generating circuit 30 generates first control signals and transmit the first control signals to the corresponding first control signal input terminals so that the DEMUX switch can transmit data signals to corresponding sub-pixels via corresponding data signal output terminals.

The second control signal generating circuit 40 is configured to generate a second control signal, and is connected to the second control signal input terminal. The second control signal generating circuit 40 is configured to generate and transmit the second control signal to the DEMUX switch 20 before scanning a plurality rows of the sub-pixels, so that each of the data signal output terminals of the DEMUS switch 20 can output a reset signal to the corresponding first data line in order to reset the first data line. The reset signal is at low voltage potential.

More particularly, the DEMUX switch 20 includes at least two first transistors T1 and at least two transistors T2. The number of the first transistors T1 equals to the number of the second transistor T2. Both of the first transistors T1 and second transistors T2 are N-type field-effect transistors.

An input terminal of the first transistor T1 is coupled to a corresponding second data line 13. An output terminal of the first transistor T1 is coupled to the corresponding data. Each of gates of the first transistor T1 is coupled to the first control signal generating circuit. Each of the input terminals of first transistors T1 is coupled to an input terminal of one of the second transistor T2. Each of the output terminals of first transistors T1 is coupled to an output terminal of one of the corresponding second transistor T2. Gates of the at least two transistors receive the second control signals.

In a first embodiment, the DEMUX switch 20 includes two first transistors T1 and two second transistors T2. Correspondingly, each DEMUX switch 20 has two data signal output terminals which are coupled to two different colored sub-pixels. The two different colored sub-pixels are a red sub-pixel and a green sub-pixel, or a blue sub-pixel and a green sub-pixel.

Figure 2:
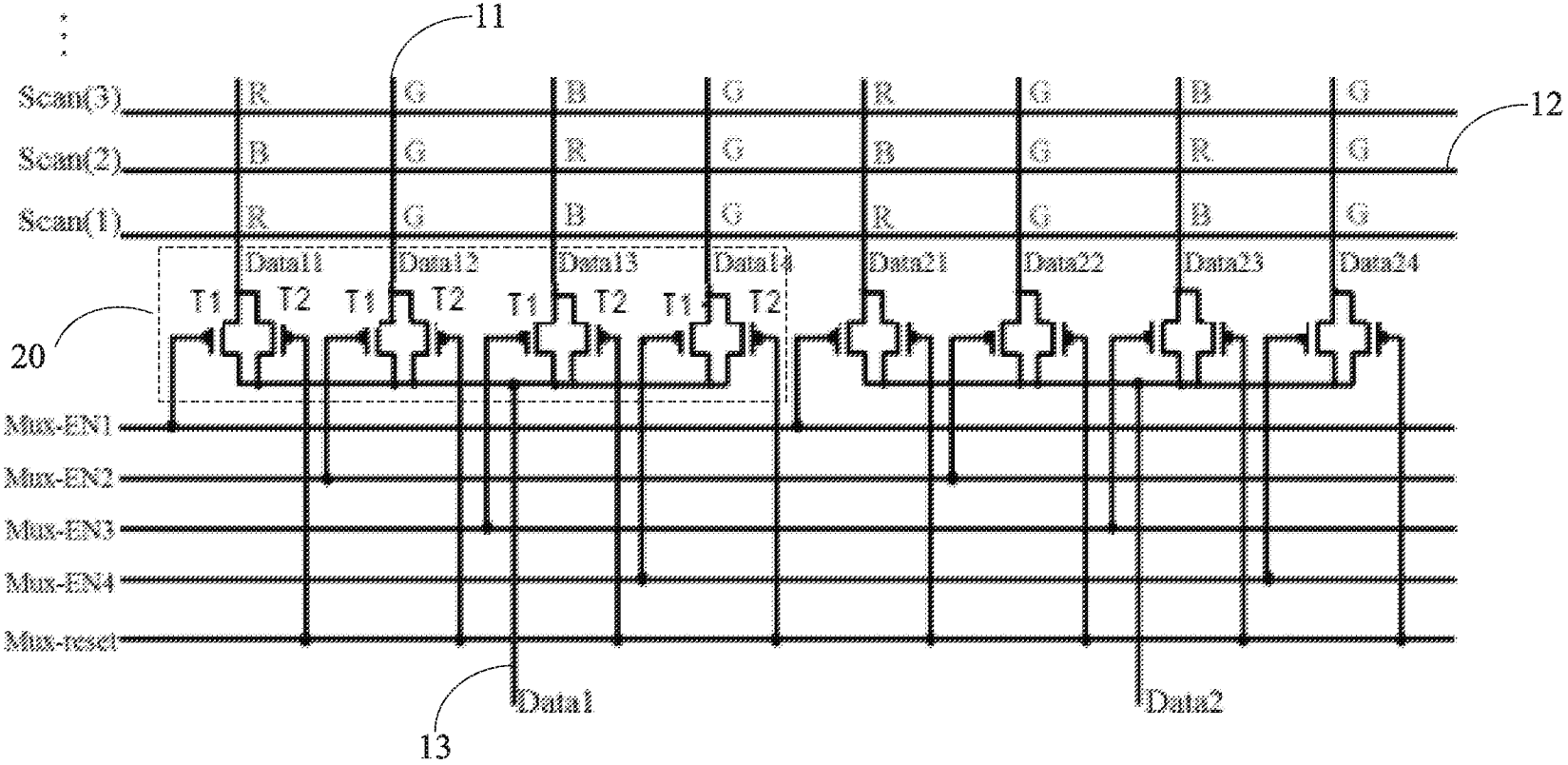
FIG. 2 illustrates a structure of a second embodiment of a DEMUX display panel of the present disclosure.

Please refer to FIG. 2. In a second embodiment, each DEMUX switch 20 has four data signal output terminals. The DEMUX switch has four first transistors T1 and four second transistors T2. Correspondingly, the DEMUX display panel is RGBG display panel that four data signal output terminals are coupled to a red sub-pixel, a blue sub-pixel and two green sub-pixels.

In some embodiments, each DEMUX switch has three data signal output terminals which are coupled to three sub-pixels in three kinds of different colors.

Figure 3:
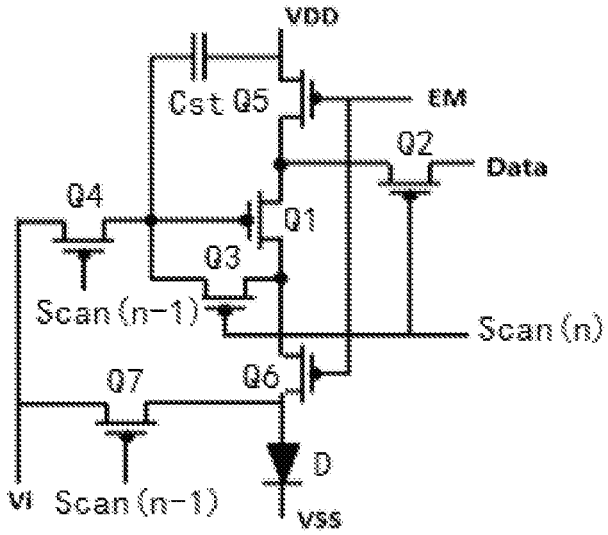
FIG. 3 illustrates a structure of a sub-pixel of the DEMUX display panel of the present disclosure.

Please refer to FIG. 3, in the first and second embodiments, each sub-pixel include a first thin film transistor Q1, a second thin film transistor Q2, a third thin film transistor Q3, a fourth thin film transistor Q4, a fifth thin film transistor Q5, a sixth thin film transistor Q6, a seventh thin film transistor Q7, an organic light-emitting diode (OLED) D and a storage capacitor Cst. The first thin film transistor Q1, the second thin film transistor Q2, the third thin film transistor Q3, the fourth thin film transistor Q4, the fifth thin film transistor Q5, the sixth thin film transistor Q6 and the seventh thin film transistor Q7 are, but not limited, N-type field-effect transistor.

Input terminals of both of the fourth thin film transistor Q4 and the seventh thin film transistor Q7 receive voltage Vi. An output terminal of the fourth thin film transistor Q4 is coupled to one end of the storage capacitor, a gate of the first thin film transistor Q1 and an input terminal of the third thin film transistor Q3. Gates of both of the fourth thin film transistor Q4 and the seventh thin film transistor Q7 are coupled to the (n−1)th scan line. The output terminal of the fourth thin film transistor Q4 and an output terminal of the seventh thin film transistor Q7 are coupled to one end of the OLED D and an output terminal of the sixth thin film transistor Q6. Another end of the storage capacitor Cst is couple to an input terminal of the fifth thin film transistor Q5 and receives voltage VDD. An output terminal of the fifth thin film transistor Q5, an output terminal of the second thin film transistor Q2 are coupled to an input terminal of the first thin film transistor Q1. An output terminal of the first thin film transistor Q1 is coupled to an output terminal Q3 and an input terminal of the sixth thin film transistor Q6. A gate of the fifth thin film transistor Q5 is coupled to a gate of the sixth thin film transistor Q6. A gate of the second thin film transistor Q2 and a gate of the third thin film transistor Q3 are coupled to the Nth scan line. An input terminal is coupled to the data line.

Figure 4:
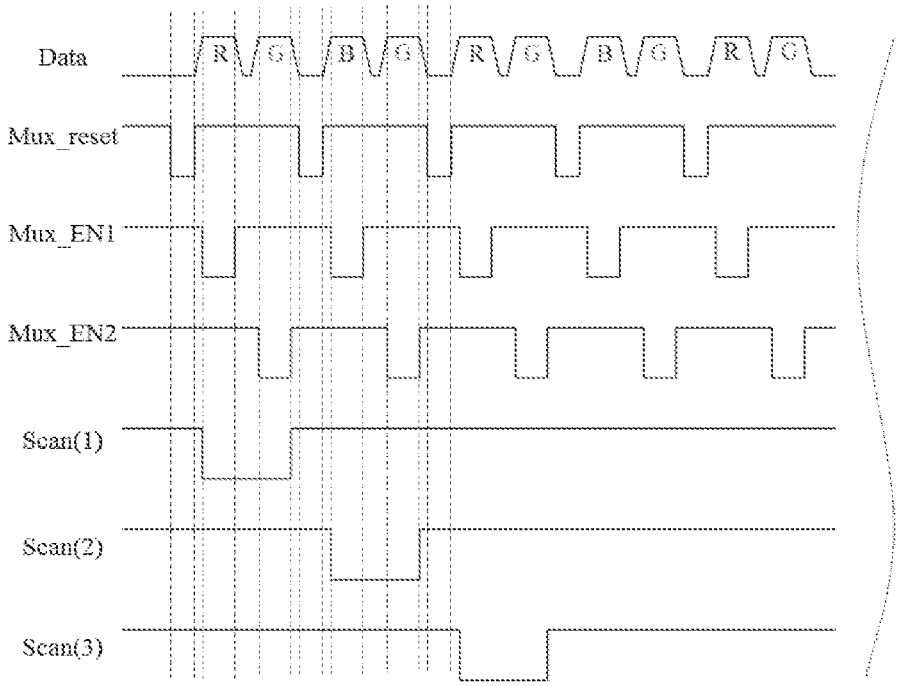
FIG. 4 illustrates a time sequence of the first embodiment of the DEMUX display panel as shown in FIG. 1.

Please refer to FIG. 4 which illustrates the time sequence of the voltages according to the first embodiment. A reset signal Mux-reset is sent, at low voltage potential, before the scan lines start working. In the meanwhile, the second data line will receive a low voltage potential signal. Therefore the voltage potential of a corresponding first data line will be reset before charging to a corresponding row of sub-pixels. Then, first control signals Mux_EN1 and Mux_EN2 will be on, i.e. at high voltage potential, and will be written into practical voltage potentials of the corresponding row of sub-pixels. At the same time, the scan lines receive corresponding scan signals Scan(n) and charge to two corresponding sub-pixels according to a data signal Data.

Figure 5:
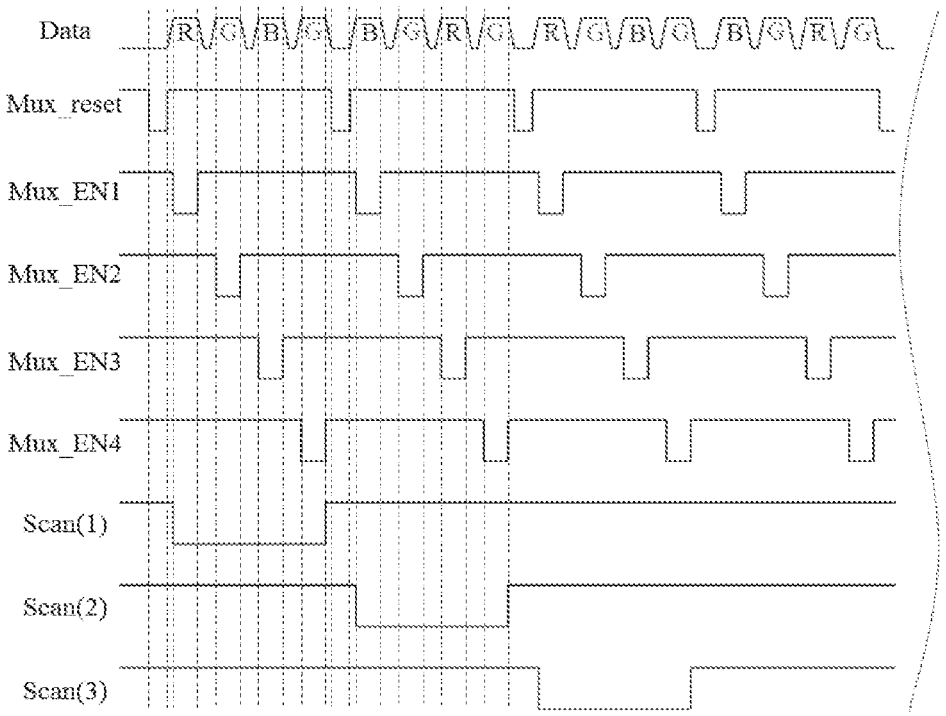
FIG. 5 illustrates a time sequence of the second embodiment of the DEMUX display panel as shown in FIG. 2.

Please refer to FIG. 5 which illustrates the time sequence of the voltages according to the second embodiment shown in FIG. 2. A reset signal Mux-reset is sent, at low voltage potential, before the scan lines start working. In the meanwhile, the second data line will receive a low voltage potential signal. Therefore the voltage potential of a corresponding first data line will be reset before charging to a corresponding row of sub-pixels. Then, the first control signals Mux-EN1, Mux-EN2, Mux-EN3, and Mxu-EN4 will be written into practical voltage potentials of the corresponding row of sub-pixels. At the same time, the scan lines receive corresponding scan signals Scan(n) and charge to four sub-pixels corresponding to the first data lines.

The present disclosure further provides a OLED display which comprises any one of the DEMUX display panel of above-mentioned embodiments.

By utilizing the second control signal generating circuit, which is connected to the second control signal input terminals, the second control signal will be generated and transmitted to the DEMUX switches so that the DEMUX switches will send reset signals to the corresponding first data line in order to reset the first data lines before charging the sub-pixels. Therefore, problems of written error resulted from the influence caused from the (n−1)th data line because the voltage potential of the (n−1)th first data line is higher than the voltage potential of the nth first data line. As a result, beneficial effect is created because the display error is avoided.

The detailed introduction of the embodiments of the DEMUX display panel and OLED display of present disclosure are illustrated as above-mention context. The specification illustrates the technologies and implementing methods of the present disclosure. Although this disclosure has been disclosed through the preferable embodiments above, the preferable embodiments above are not utilized to limit this disclosure. One having ordinary skills can change and modify without violating the concepts and scope of this disclosure. Therefore, the scope that this disclosure protects should not be limited by the embodiments in specification and should base on the scope defined by the claims.

What is claimed is:

1. A demultiplexer (DEMUX) display panel, comprising:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data lines connect between the at least two data signal output terminals and at least two of the sub-pixels;

a first control signal generating circuit connected to the at least two first control signal input terminals, and configured to generate a first control signal, wherein the first control signal is sent to one of the corresponding first control signal input terminals to make the DEMUX switch transmit a data signal to the corresponding sub-pixels through a corresponding data signal output terminal; and a second control signal generating circuit connected to the second control signal input terminal, and configured to generate a second control signal, wherein the second control signal is sent to the DEMUX switch before scanning the sub-pixels to make the DEMUX switch transmit a reset signal to the corresponding first data lines through both of the data signal output terminals;

wherein the DEMUX switch comprises at least two first transistors and at least two second transistors;

wherein input terminals of the first transistors connect to the corresponding second data line, output terminals of the first transistors connect to one of the corresponding first data lines and the corresponding sub-pixels, and a gate of the first transistors connects to the first control signal generating circuit;

wherein each one of the input terminals of both of the first transistors connects to one of the input terminals of both of the second transistors, the output terminals of both of the first transistors connect to output terminals of the corresponding second transistors, and gates of the at least two second transistors connect to each other to receive the second control signal;

each of the DEMUX switches comprises at least two data signal output terminals connected to at least two different colored sub-pixels; and wherein each of the DEMUX switches comprises four data signal output terminals connected to four sub-pixels arranged adjacently, and the four sub-pixels arranged in a sequence of a red sub-pixel, a green sub-pixel, a blue sub-pixel, and a green sub-pixel, and even rows of the first control signals are configured to be written into voltage potentials of the green sub-pixels.

2. The DEMUX display panel according to claim 1, wherein the first transistors and the second transistors are N-type thin film transistors.

3. The DEMUX display panel according to claim 1, wherein the data signal output terminals of the DEMUX switches transmit low potential voltages as the reset signal to the corresponding first data lines before scan lines receive scan signals.

4. The DEMUX display panel according to claim 1, wherein each of the sub-pixels comprises a first thin film transistor, a second thin film transistor, a third thin film transistor, a fourth thin film transistor, a fifth thin film transistor, a sixth thin film transistor, a seventh thin film transistor, an organic light-emitting diode, and a storage capacitor; and wherein an input terminal of the fourth thin film transistor and an input terminal of the seventh thin film transistor receive a Vi voltage, an output terminal of the fourth thin film transistor connects to a first terminal of the storage capacitor, a gate of the first thin film transistor and an input terminal of the third thin film transistor, a gate of the fourth thin film transistor and a gate of the seventh thin film transistor connect to an (n−1)th scan line, an output terminal of the seventh thin film transistor connects to the organic light-emitting diode and an output terminal of the sixth thin film transistor, a second terminal of the storage capacitor connects to an input terminal of the fifth thin film transistor and receives a VDD voltage, an output terminal of the fifth thin film transistor and an output terminal of the second thin film transistor connect to an input terminal of the first thin film transistor, an output terminal of the first thin film transistor connects to an output terminal of the third thin film transistor and an input terminal of the sixth thin film transistor, a gate of the fifth thin film transistor connects to a gate of the sixth thin film transistor, a gate terminal of the second thin film transistor connects to a gate of the third thin film transistor and an (n)th scan line, and an input terminal of the second thin film transistor connects to one of the corresponding first data lines.

5. A demultiplexer (DEMUX) display panel, comprising:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data lines connect between the at least two data signal output terminals and at least two of the sub-pixels;

a first control signal generating circuit connected to the at least two first control signal input terminals, and configured to generate a first control signal, wherein the first control signal is sent to one of the corresponding first control signal input terminals to make the DEMUX switch transmit a data signal to the corresponding sub-pixels through a corresponding data signal output terminal; and a second control signal generating circuit connected to the second control signal input terminal, and configured to generate a second control signal, wherein the second control signal is sent to the DEMUX switch before scanning the sub-pixels to make the DEMUX switch transmit a reset signal to the corresponding first data lines through both of the data signal output terminals;

wherein each of the DEMUX switches comprises four data signal output terminals connected to four sub-pixels arranged adjacently, and the four sub-pixels arranged in a sequence of a red sub-pixel, a green sub-pixel, a blue sub-pixel, and a green sub-pixel, and even rows of the first control signals are configured to be written into voltage potentials of the green sub-pixels.

6. The DEMUX display panel according to claim 5, wherein the DEMUX switch comprises at least two first transistors and at least two second transistors;

wherein input terminals of the first transistors connect to the corresponding second data line, output terminals of the first transistors connect to one of the corresponding first data lines and the corresponding sub-pixels, and a gate of the first transistors connects to the first control signal generating circuit; and wherein each one of the input terminals of both of the first transistors connects to one of the input terminals of both of the second transistors, the output terminals of both of the first transistors connect to output terminals of the corresponding second transistors, and gates of the at least two second transistors connect to each other to receive the second control signal.

7. The DEMUX display panel according to claim 6, wherein the first transistors and the second transistors are N-type thin film transistor.

8. The DEMUX display panel according to claim 5, wherein the data signal output terminals of the DEMUX switches transmit low potential voltages as the reset signal to the corresponding first data lines before scan lines receive scan signals.

9. The DEMUX display panel according to claim 5, wherein each of the sub-pixels comprises a first thin film transistor, a second thin film transistor, a third thin film transistor, a fourth thin film transistor, a fifth thin film transistor, a sixth thin film transistor, a seventh thin film transistor, an organic light-emitting diode, and a storage capacitor; and wherein an input terminal of the fourth thin film transistor and an input terminal of the seventh thin film transistor receive a Vi voltage, an output terminal of the fourth thin film transistor connects to a first terminal of the storage capacitor, a gate of the first thin film transistor and an input terminal of the third thin film transistor, a gate of the fourth thin film transistor and a gate of the seventh thin film transistor connect to an (n−1)th scan line, an output terminal of the seventh thin film transistor connects to the organic light-emitting diode and an output terminal of the sixth thin film transistor, a second terminal of the storage capacitor connects to an input terminal of the fifth thin film transistor and receives a VDD voltage, an output terminal of the fifth thin film transistor and an output terminal of the second thin film transistor connect to an input terminal of the first thin film transistor, an output terminal of the first thin film transistor connects to an output terminal of the third thin film transistor and an input terminal of the sixth thin film transistor, a gate of the fifth thin film transistor connects to a gate of the sixth thin film transistor, a gate of the second thin film transistor connects to a gate of the third thin film transistor and an (n)th scan line, and an input terminal of the second thin film transistor connects to one of the corresponding first data lines.

10. An organic light-emitting diode (OLED) display comprising a demultiplexer (DEMUX) display panel, the DEMUX display panel comprising:

an array substrate comprising a pixel area defined by a plurality of first data lines intersecting a plurality of scan lines, wherein the pixel area comprises sub-pixels;

a plurality of DEMUX switches, each of the DEMUX switches comprising at least one data signal input terminal, at least two data signal output terminals, at least two first control signal input terminals, and a second control signal input terminal, wherein a corresponding second data line connects to the data signal input terminal, the corresponding first data lines connect between the at least two data signal output terminals and at least two of the sub-pixels;

a first control signal generating circuit connected to the at least two first control signal input terminals, and configured to generate a first control signal, wherein the first control signal is sent to one of the corresponding first control signal input terminals to make the DEMUX switch transmit a data signal to the corresponding sub-pixels through a corresponding data signal output terminal; and a second control signal generating circuit connected to the second control signal input terminal, and configured to generate a second control signal, wherein the second control signal is sent to the DEMUX switch before scanning the sub-pixels to make the DEMUX switch transmit a reset signal to the corresponding first data lines through both of the data signal output terminals;

wherein each of the DEMUX switches comprises four data signal output terminals connected to four sub-pixels arranged adjacently, and the four sub-pixels arranged in a sequence of a red sub-pixel, a green sub-pixel, a blue sub-pixel, and a green sub-pixel, and even rows of the first control signals are configured to be written into voltage potentials of the green sub-pixels.

11. The OLED display according to claim 10, wherein the DEMUX switch comprises at least two first transistors and at least two second transistors;

wherein input terminals of the first transistors connect to the corresponding second data line, output terminals of the first transistors connect to one of the corresponding first data lines and the corresponding sub-pixels, and a gate of the first transistors connects to the first control signal generating circuit; and wherein the input terminals of both of the first transistors connect to an input terminal of one of the second transistors, the output terminals of both of the first transistors connect an output terminal of the corresponding second transistor, and gates of the at least two second transistors connect to each other to receive the second control signal.

12. The OLED display according to claim 11, wherein the first transistors and the second transistors are N-type thin film transistor.

* * * * *